US007857300B2

(12) United States Patent
Moore et al.

(10) Patent No.: US 7,857,300 B2
(45) Date of Patent: Dec. 28, 2010

(54) APPARATUS AND METHOD FOR DISK STACKING AND COMPILING MEDIA SHEETS

(75) Inventors: Steven Robert Moore, Pittsford, NY (US); Jeffrey Gramowski, North Chili, NY (US); Richard J. Milillo, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 148 days.

(21) Appl. No.: 12/207,977

(22) Filed: Sep. 10, 2008

(65) Prior Publication Data

US 2010/0059921 A1 Mar. 11, 2010

(51) Int. Cl.
*B65H 37/04* (2006.01)

(52) U.S. Cl. ..... 270/58.11; 270/58.08; 270/58.12

(58) Field of Classification Search ..... 270/58.08, 270/58.11, 58.12, 58.13
See application file for complete search history.

(56) References Cited

U.S. PATENT DOCUMENTS 5,288,062 A * 2/1994 Rizzolo et al. ..... 270/58.12
5,409,202 A 4/1995 Naramore et al.
5,476,256 A 12/1995 Fortuna et al.
5,551,681 A * 9/1996 Ferrara ..... 270/58.08
5,639,080 A * 6/1997 Evans ..... 270/58.28
6,283,354 B1 * 9/2001 Hirota et al. ..... 227/39
6,328,299 B1 * 12/2001 Coombs ..... 270/58.08

* cited by examiner

*Primary Examiner*—Patrick Mackey
(74) *Attorney, Agent, or Firm*—Matthew C. Loppnow; Prass LLP

(57) ABSTRACT

An apparatus (100) and method (1200) that disk stacks and compiles media sheets. The apparatus can include a media sheet transport (120) configured to transport media sheets and a stacker (130) configured to stack the media sheets (110). The apparatus can include a rotatable disk (140) coupled to the media transport, the rotatable disk configured to receive a leading edge (112) of a media sheet and configured to transport the media sheet to the stacker. The apparatus can include a compiler (150) configured to compile a set of a plurality of the media sheets and an ejector (160) configured to eject the set of a plurality of the media sheets from the compiler onto the stacker. One of the rotatable disk and at least a portion of the compiler can be movable (171) relative to each other to switch between the rotatable disk providing media sheets to the stacker and the rotatable disk providing media sheets to the compiler.

19 Claims, 8 Drawing Sheets

APPARATUS AND METHOD FOR DISK STACKING AND COMPILING MEDIA SHEETS

BACKGROUND

Disclosed herein is an apparatus and method that disk stacks and compiles media sheets in a system that transports printed media sheets from a media transport onto a media sheet stack.

Presently, in electrophotographic and other printing systems, an image is typically recorded in the form of a latent electrostatic image upon a photosensitive member. The latent image is subsequently developed on the photosensitive member by applying electroscopic marking particles, commonly referred to as toner. The toner image is then transferred from the photosensitive member to a media sheet, such as a sheet of paper, a plastic sheet, a transparency, or any other media sheet. The transferred image is then affixed or fused to the media sheet, for example, by using heat and pressure applied using a fuser assembly. The resulting media sheets are then output onto a stack in a stacker.

Reliable and robust stacker modules are required for production printing systems and other systems that transport media sheets onto a stack. The media sheets can be compiled or transported onto a stack using a disk system. Some printing system users may also require a stapling or stitching capability for finishing document sets of media sheets. The users of such systems may further require automatic handling of sheets that are printed and then compiled, such as by collating, finishing, fastening, and other compiling methods. It could be highly desirable from a user workflow perspective to provide a finisher destination that has both stacking and set finishing capabilities. Otherwise, the customer is forced to pre-select finisher destinations based upon individual job characteristics. Unfortunately, while disk stacking can be used for either stacking or set compiling, current systems only offer either pure stacking or pure set compiling, but not both due to space, efficiency, and other constraints.

Thus, there is a need for an apparatus and method that disk stacks and compiles media sheets.

SUMMARY

An apparatus and method that disk stacks and compiles media sheets. The apparatus can include a media sheet transport configured to transport media sheets and a stacker configured to stack the media sheets. The apparatus can include a rotatable disk coupled to the media transport, the rotatable disk configured to receive a leading edge of a media sheet and configured to transport the media sheet to the stacker. The apparatus can include a compiler configured to compile a set of a plurality of the media sheets and an ejector configured to eject the set of a plurality of the media sheets from the compiler onto the stacker. The rotatable disk or at least a portion of the compiler can be movable relative to each other to switch between the rotatable disk providing media sheets to the stacker and the rotatable disk providing media sheets to the compiler.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
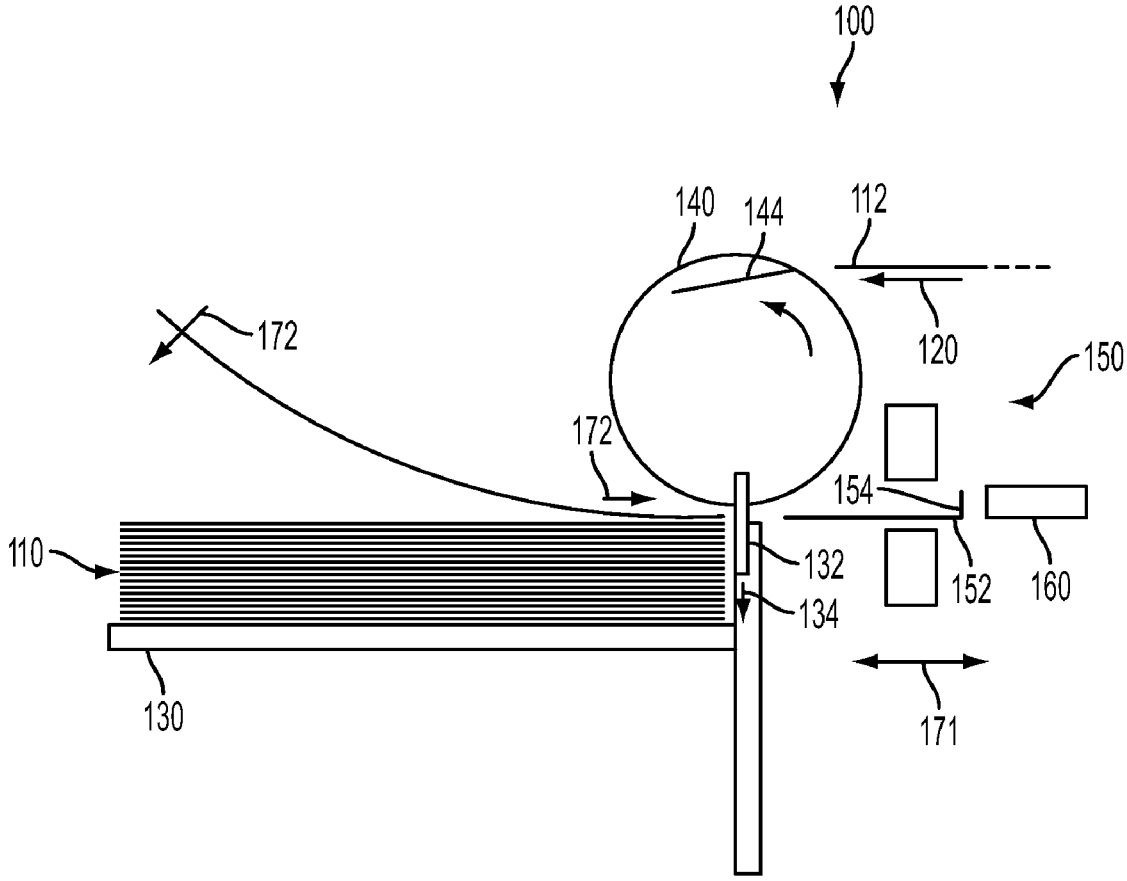
FIG. 1 is an exemplary illustration of an apparatus according to a possible embodiment.
Figure 2:
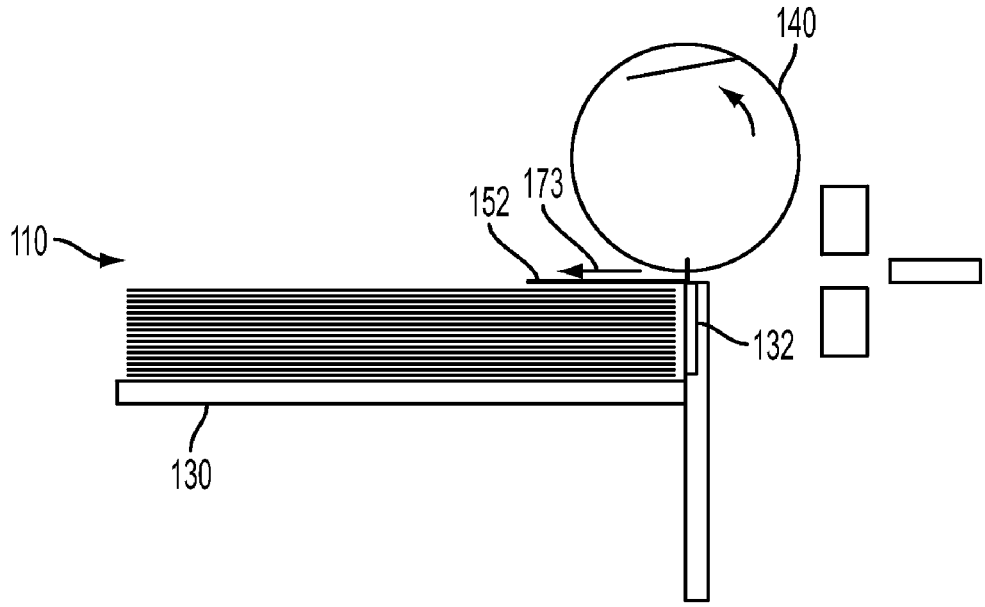
FIGS. 2-5 are exemplary illustrations of an apparatus according to a possible embodiment.
Figure 3:
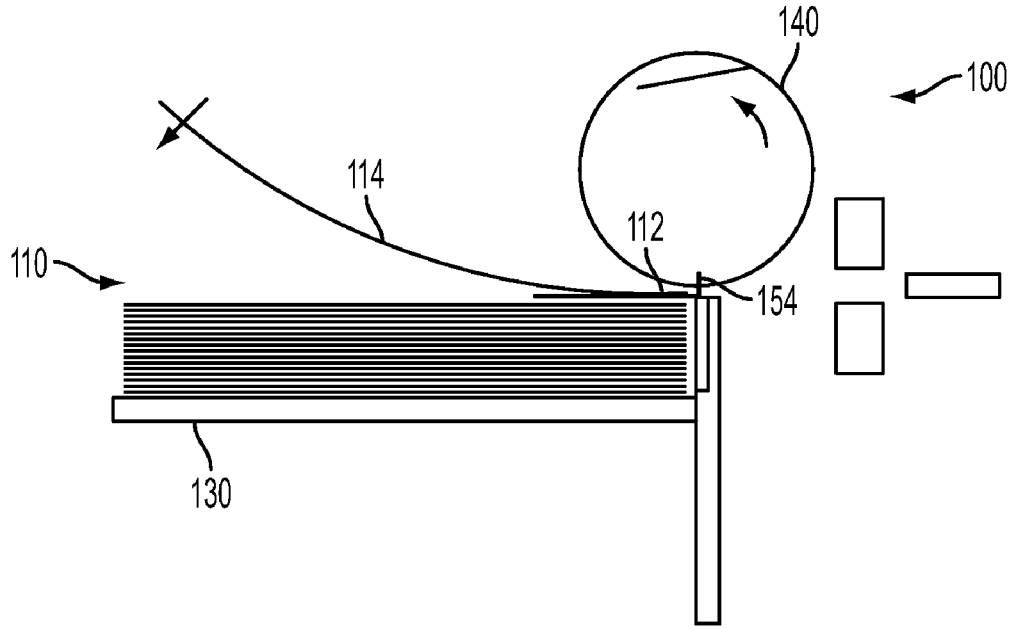
Figure 4:
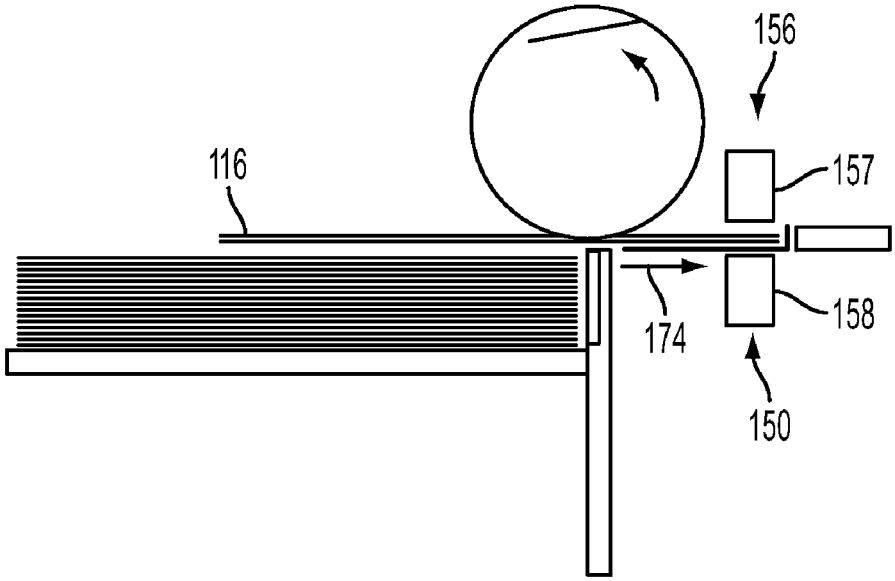
Figure 5:
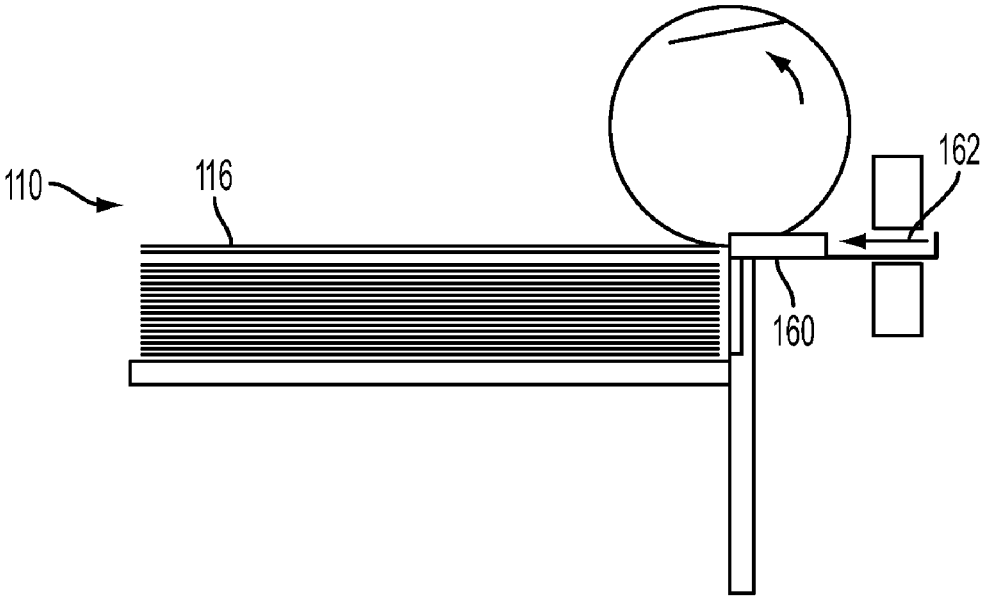

The embodiments include an apparatus for disk stacking and compiling media sheets. The apparatus can include a media sheet transport configured to transport media sheets and a stacker configured to stack the media sheets. The apparatus can include a rotatable disk coupled to the media transport, the rotatable disk configured to receive a leading edge of a media sheet and configured to transport the media sheet to the stacker. The apparatus can include a compiler configured to compile a set of a plurality of the media sheets and an ejector configured to eject the set of a plurality of the media sheets from the compiler onto the stacker. The rotatable disk or at least a portion of the compiler can be movable relative to each other to switch between the rotatable disk providing media sheets to the stacker and the rotatable disk providing media sheets to the compiler.

The embodiments further include an apparatus for disk stacking and compiling media sheets. The apparatus can include a media sheet transport configured to transport media sheets and a stacker configured to stack the media sheets. The apparatus can include a rotatable disk coupled to the media transport, the rotatable disk configured to receive a leading edge of a media sheet and configured to transport the media sheet to the stacker. The apparatus can include a retractable stacker register, where the retractable stacker register can be configured to register an edge of media sheets. The apparatus can include a compiler configured to compile a set of a plurality of the media sheets. The compiler can include a compiler tray configured to receive the set of a plurality of the media sheets and the compiler tray can include a compiler tray register configured to register an edge of media sheets. The apparatus can include an ejector operable at least parallel to a planar surface of stacked media sheets to eject the set of a plurality of the media sheets from the compiler onto the stacker. The rotatable disk or the compiler can be movable relative to each other to switch between the rotatable disk providing media sheets to the stacker and the rotatable disk providing media sheets to the compiler.

The embodiments further include a method of detecting the position of media in an apparatus having a media sheet transport, a stacker, a rotatable disk coupled to the media transport, a compiler, and an ejector. The method can include transporting media sheets in the media sheet transport, transporting the media sheets in the rotatable disk using a leading edge of media sheets, and stacking the media sheets on the stacker. The method can include compiling, with the compiler, a set of a plurality of the media sheets, and ejecting, with the ejector, the set of a plurality of the media sheets from the compiler onto the stacker. The method can include switching between the rotatable disk providing media sheets to the compiler and the rotatable disk providing media sheets to the stacker by moving the rotatable disk or the compiler relative to each other to switch between the rotatable disk providing media sheets to the stacker and the rotatable disk providing media sheets to the compiler.

FIG. 1 is an exemplary illustration of an apparatus 100 according to a possible embodiment. The apparatus 100 may be a document stacker, a printer, a scanner, a multifunction media device, a xerographic machine, or any other device that transports media. The apparatus 100 can include a media sheet transport 120 configured to transport media sheets and a stacker 130 configured to stack the media sheets 110. The stacker 130 can be configured to stack single media sheets and compiled sets of a plurality of media sheets. The apparatus 100 can include a rotatable disk 140 coupled to the media transport 120. The rotatable disk 140 can be configured to receive a leading edge 112 of a media sheet and configured to transport the media sheet to the stacker 130. For example, the rotatable disk 140 can include one or more slots 144 that can receive the leading edge 112 of a media sheet and can transport the media sheet to the stacker 130. The rotatable disk 140 may be a disk, may be a cylinder, or may be one of a plurality of rotatable disks or cylinders. The apparatus 100 can include retractable stacker register 132. The retractable stacker register 132 can be configured to register an edge of media sheets. The retractable stacker register 132 can be a registration wall, can be a registration wall with slots, can be registration fingers, or can be any other register that can register an edge of media sheets. The retractable stacker register 132 can retract 134 in a direction perpendicular to the planar surface of stacked media sheets 110.

The apparatus 100 can include a compiler 150 configured to compile a set of a plurality of the media sheets and an ejector 160 configured to eject the set of a plurality of the media sheets from the compiler 150 onto the stacker 130. As used herein, 'compiler' shall be defined as any device configured to at least compile a set of a plurality of the media sheets, such as a device that can group, collect, or amass a plurality of media sheets into a set or a stack of media sheets distinguishable from media sheets on the stacker 130. The compiler 150 can also be configured to finish the set of a plurality of the media sheets by fastening together the set of a plurality of the media sheets. The compiler 150 can include a compiler tray 152 configured to receive the set of a plurality of the media sheets. The compiler tray 152 can include a compiler tray register 154 configured to register an edge of media sheets. The compiler register 154 can be a registration wall, can be a registration wall with slots, can be registration fingers, or can be any other register that can register an edge of media sheets. The ejector 160 can be a piston, a sliding beam, a plurality of fingers, or any other devices that can eject or move a set of a plurality of media sheets onto a stacker 130.

The rotatable disk 140 or at least a portion of the compiler 150 can be movable 171 relative to each other to switch between the rotatable disk providing media sheets to the stacker and the rotatable disk providing media sheets to the compiler. For example, the rotatable disk 140 or the compiler 150 can be movable in a substantially linear direction relative to each other. The rotatable disk 140 or at least a portion of the compiler 150 can be movable relative to each other and in a substantially planar direction 171 relative to a planar surface of stacked media sheets 110 to switch between the rotatable disk 140 providing media sheets to the stacker 130 and the rotatable disk 140 providing media sheets to the compiler 150.

According to a related embodiment, the apparatus 100 can include a media sheet transport 120 configured to transport media sheets and a stacker 130 configured to stack the media sheets 110. The apparatus 100 can include a rotatable disk 140 coupled to the media transport 120. The rotatable disk can be configured to receive a leading edge 112 of a media sheet and can be configured to transport the media sheet to the stacker 130. The apparatus 100 can include a retractable stacker register 132. The retractable stacker register 132 can be configured to register an edge of media sheets. The apparatus 100 can include a compiler 150 configured to compile a set of a plurality of the media sheets. The compiler 150 can include a compiler tray 152 configured to receive the set of a plurality of the media sheets and the compiler tray can include a compiler tray register 154 configured to register an edge of media sheets. The compiler tray 152 can be configured to move parallel 171 to a planar surface of stacked media sheets 110 into an intercept position to intercept media sheets between the rotatable disk 140 and the stacker 130 and can be configured to compile the set of a plurality of the media sheets. The compiler tray 152 can be configured to move in a direction away from the intercept position to provide the set of a plurality of the media sheets to the compiler 150. The compiler 150 can be a finisher configured to finish the set of a plurality of the media sheets by fastening together the set of a plurality of the media sheets. The apparatus 100 can include an ejector 160 operable parallel 171 to a planar surface of stacked media sheets to eject the set of a plurality of the media sheets from the compiler 150 onto the stacker 130. The ejector 160 can be operable in a linear direction parallel 171 to a planar surface of stacked media sheets. The rotatable disk 140 or the compiler 150 can be movable 171 relative to each other to switch between the rotatable disk 140 providing media sheets to the stacker 130 and the rotatable disk 140 providing media sheets to the compiler 150.

For example, a rotatable disk 140, such as a disk transport, can guide successive media sheet lead edges 112 around a 180 degree turn onto the stacker 130. The compiler 150 can include set finishing, stitching, stapling, or other compiling components adjacent to the stacker 130. These components can be integrated into a disk stacker including a rotatable disk 140 without compromising the inherent stacking performance offered by the rotatable disk 140. In operation, the incoming media sheet lead edge 112 can enter the disk slot 144 at a load point. The rotatable disk 140 can drive the media sheet lead edge 112 toward the retractable registration wall 132. The retractable registration wall 132 can decelerate or stop the media sheet lead edge 112. The rest of a media sheet can be driven 172 to the stacker beyond the load point optionally using a trail edge assisting device (not shown). The rotatable disk 140 can continue the cycle for a next media sheet. A tray of the stacker 130 can lower as needed to maintain the top height of the media sheet 110 stack. For a media sheet set processing mode, operation can be similar to a stacking mode except the retractable stacker register 132 can move out of way. The compiler tray 152 can then move to the left over the top of the media sheet 110 stack. Media sheets can compile against the compiler tray register 154. The compiler tray 152 can include a mechanism (not shown) to clamp a set of media sheets and can move to the right to a finishing position. The ejector 160 can eject the compiled and finished set media sheets to the left onto the top of the media sheet 100 stack. Slots in the compiler tray register 154 can allow the ejector 160 to pass through to eject the compiled and finished set media sheets. The cycle can then repeat. Some media sheets sets may need to skip pitch depending on the finish and eject cycle time. For example, the rotating disk 140 and other elements of the apparatus 100 can abstain from transporting additional media sheets while waiting for a set of media sheets to be finished an ejected.

FIGS. 2-5 are exemplary illustrations of an apparatus 100 according to a possible embodiment. The compiler tray 152 can be configured to move 173 in a direction parallel to a planar surface of stacked media sheets 110 into an intercept position to intercept media sheets between the rotatable disk 140 and the stacker 130. The retractable stacker register 132 can retract out of a register position before or when the compiler tray 152 moves into the intercept position. When in the intercept position, the compiler tray register 154 can register an edge 112 of a media sheet 114 transported by the rotatable disk 140. The compiler 150 can include a finisher module 156 configured to finish the set 116 of a plurality of the media sheets. The finisher module 150 can include a finisher head 158, such as a stitch head, a stapler, or any other device that can finish, such as bind, fasten together, or otherwise finish, a set of a plurality of media sheets. The finisher module 150 can also include an anvil 157 that can be used in conjunction with the finisher head 158 to finish the set 116 of a plurality of media sheets. The finisher head 158 can be located above the anvil 157, the anvil 157 can be located above the finisher head 158, or the anvil 157 and the finisher head 158 can be located in any other useful position in a compiler to finish a set of a plurality of media sheets. The compiler tray 152 can be configured to move in a direction 174 away from the intercept position to provide the set 160 of a plurality of the media sheets to the finisher module 156 to finish the set 116 of a plurality of the media sheets. The ejector 160 can be configured to eject 162 the set 116 of a plurality of the media sheets from the compiler 150 onto the stacker 130.

For example, earlier media sheets 110 or sets 116 of media sheets may already be placed onto the stacker 130. Set processing can start with the next media sheet 114 delivered by the rotatable disk 140. The retractable stacker register 132 can retract and the compiler tray 152 can move 173 to the left until it is positioned slightly above the stack of media sheets 110. Successive sheets can be transported by the rotatable disk 140 onto the compiler tray 152 and registered against the compiler tray register 154. The compiler tray length in the process direction need not be as long as the media sheet length, but can be long enough to allow stable support of the leading edge 114 of a set 116 of media sheets. An edge tamping mechanism (not shown) can be used to align sheets in the cross-process direction and also in the process direction at a trail edge of media sheets. After a full set 116 of media sheets has been compiled on the compiler tray 152, a clamping device (not shown) can clamp the leading edges of the set 116 of media sheets in place within the compiler tray 152. The compiler tray 152 can then move 174 and stop at a position where the leading edge of the set 116 of media sheets is properly positioned within the throat of one or more stapler heads, stitcher heads, or other finishing mechanisms in the compiler 150. The set 116 of media sheets can then be appropriately finished in this position. The ejector 160 can then push the finished set to the left until it is fully supported on the stack of media sheets 110. The ejector 160 can then retract and the apparatus 100 can now be ready to accept the next sheet in either stacker mode or in set compiling mode. Thus, a relative motion between a rotatable disk 140 assembly and a compiler 150 assembly can be used to switch between pure stacking and set compiling and/or finishing.

Figure 6:
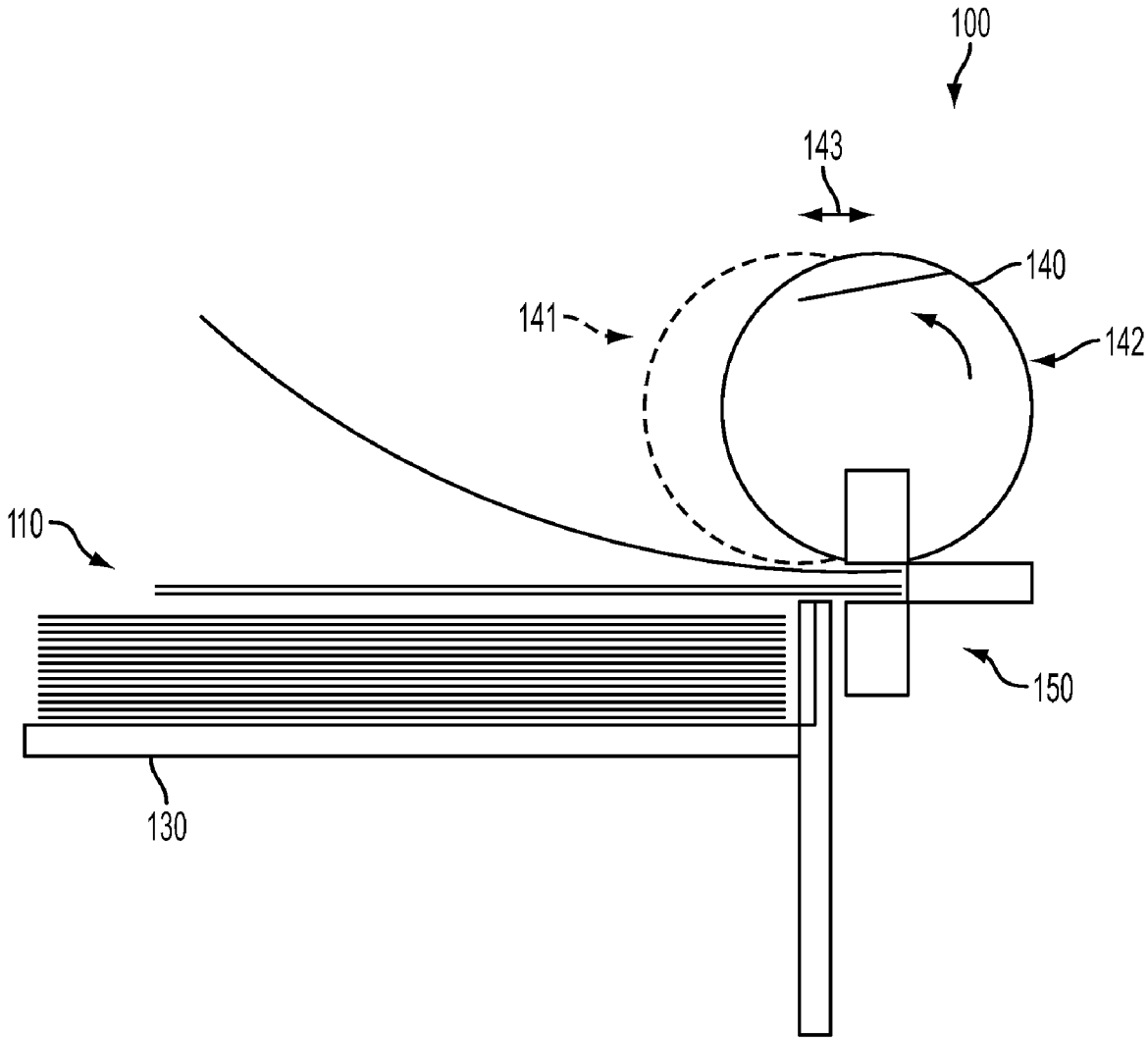
FIG. 6 is an exemplary illustration of an apparatus according to a possible embodiment.

FIG. 6 is an exemplary illustration of an apparatus 100 according to a possible embodiment. The rotatable disk 140 can be configured to move in a direction 143 parallel to a planar surface of stacked media sheets 110 between a position 141 to transport the media sheets to the stacker 130 and a position 142 to transport media sheets to the compiler 150. Thus, either the compiler 150 or the rotatable disk 140 can move to switch between the rotatable disk 140 providing media sheets to the stacker 130 and the rotatable disk 140 providing media sheets to the compiler 150. For example, the compiler 150 can be stationary and the rotatable disk 140 can translate to the right so media sheets can be registered into a stationary compiler tray. Otherwise, stacking and set compiling operation can be similar to other embodiments.

Figure 7:
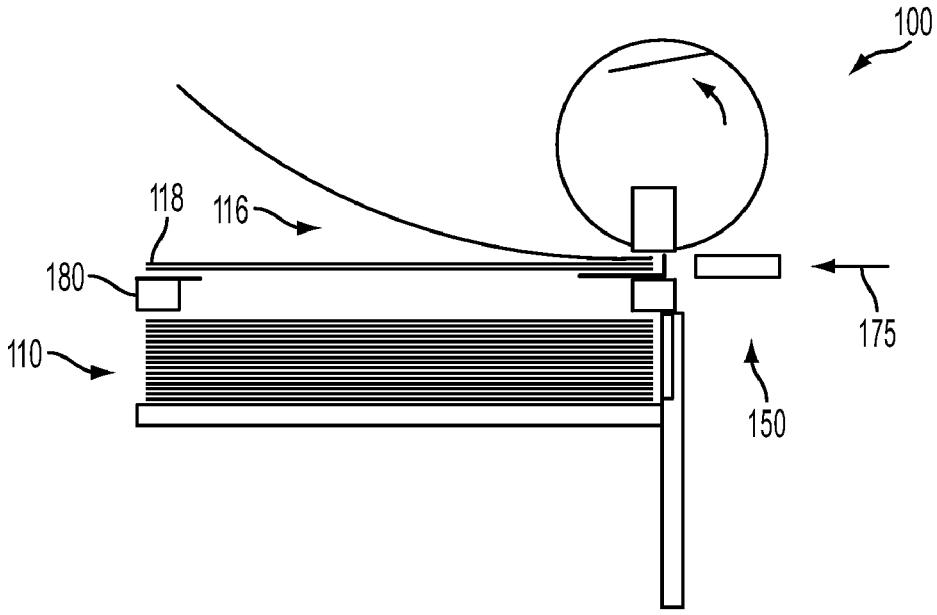
FIGS. 7 and 8 are exemplary illustrations of an apparatus according to a possible embodiment.
Figure 8:
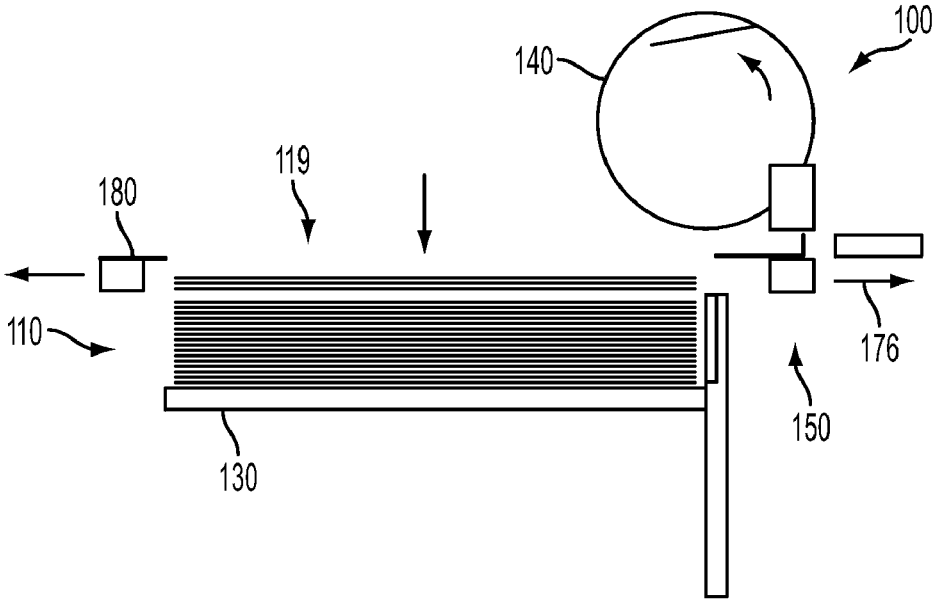

FIGS. 7 and 8 are exemplary illustrations of an apparatus 100 according to a possible embodiment. The compiler 150 can be configured to move in a direction 175 parallel to a planar surface of stacked media sheets 110 into an intercept position to intercept the set 116 of a plurality of the media sheets, compile the set 116 of a plurality of the media sheets, and finish the set 116 of a plurality of the media sheets. The apparatus 100 can include a media sheet trail edge support 180 configured to support a trail edge 118 of media sheets when the compiler 150 is in the intercept position. The compiler 150 can be configured to move in a direction 176 parallel to a planar surface of stacked media sheets 110 out of the intercept position to provide a finished set 119 of a plurality of the media sheets to the stacker 130. The compiler 150 can also move in a direction 176 parallel to a planar surface of stacked media sheets 110 out of the intercept position to allow the rotatable disk 140 to transport media sheets to the stacker 130. The media sheet trail edge support 180 can also move out of an intercept position to provide the finished set 119 of a plurality of the media sheets to the stacker 130 and to allow the rotatable disk 140 to transport media sheets directly to the stacker 130. For example, the compiler 150 can move 175 into position directly above a stacking tray of the stacker 130. The stacking tray can be dropped so that a low profile stapler, stitch head, or other finisher of the compiler 150 can move over the media sheet 110 stack. The media sheet trail edge support 180 can move in a coordinated manner with the compiler 150. The set 116 can be compiled into the compiler 150. Then, the compiler 150 and the media sheet trail edge support 180 can retract 176, causing the finished set 119 to drop onto the media sheet 110 stack.

Figure 9:
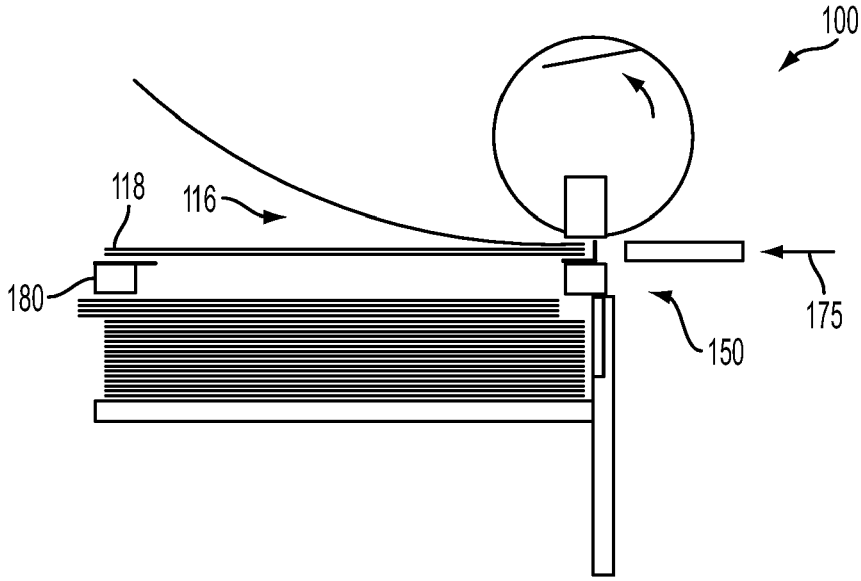
FIGS. 9 and 10 are exemplary illustrations of an apparatus according to a possible embodiment.
Figure 10:
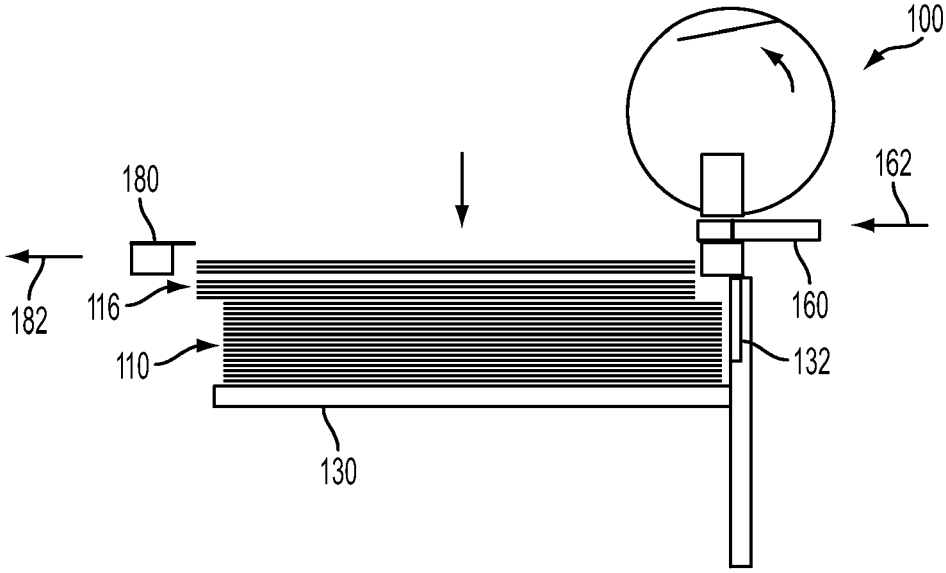

FIGS. 9 and 10 are exemplary illustrations of an apparatus 100 according to a possible embodiment. The compiler 150 can be configured to move in a direction 175 parallel to a planar surface of stacked media 110 sheets into an intercept position to intercept the set 116 of a plurality of the media sheets and compile the set 116 of a plurality of the media sheets. The compiler 150 can also finish the set 116 of a plurality of the media sheets. The ejector 160 can be configured to eject 162 the set 116 of a plurality of the media sheets from the compiler 150 onto the stacker 130 while the compiler 150 is still in the intercept position. The media sheet trail edge support 180 can move 182 out of an intercept position when the ejector 160 ejects the set 116 of a plurality of the media sheets from the compiler 150 onto the stacker 130 while the compiler 150 is still in the intercept position. Thus, multiple sets of media sheets can be compiled and/or finished while the compiler 150 remains in the intercept position.

For example, a set 116 of media sheets can be ejected without requiring the compiler 150 to first retract. The ejector 160 can push the set 116 to the right, out of the compiler 150, and onto the media sheet 110 stack. Compiled sets 116 can end up being offset in the process direction from stacked media sheets 110 by a small distance. The lower media sheets 110 in the stacker 130 that were previously stacked sheetwise were registered against stacker register 132 can be in one position and upper sets 116 of media sheets in the stacker 130 can be offset slightly to the left in another position to accommodate the compiler 150.

Figure 11:
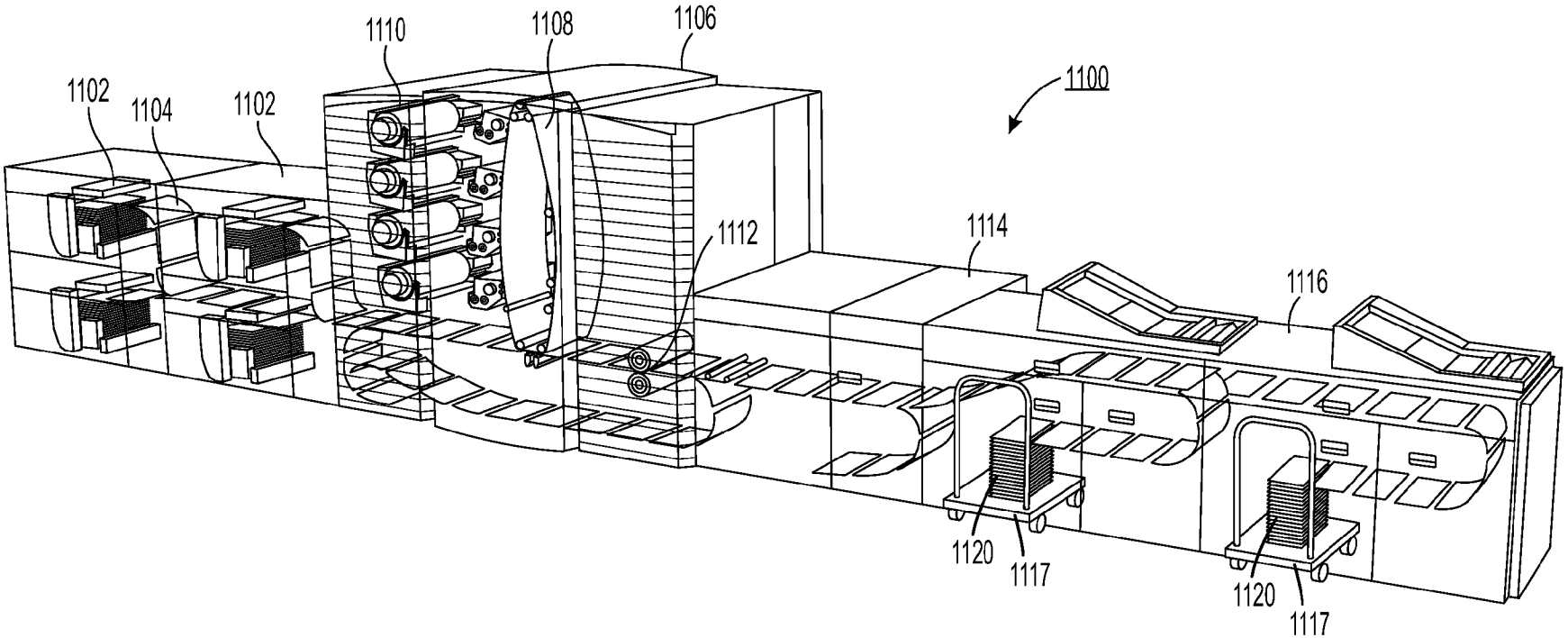
FIG. 11 illustrates an exemplary printing apparatus according to a possible embodiment.

FIG. 11 illustrates an exemplary printing apparatus 1100 that can include or can be the apparatus 100. As used herein, the term "printing apparatus" encompasses any apparatus, such as a digital copier, bookmaking machine, multifunction machine, and other printing devices that perform a print outputting function for any purpose. The printing apparatus 1100 can be used to produce prints from various media, such as coated, uncoated, previously marked, or plain paper sheets. The media can have various sizes and weights. In some embodiments, the printing apparatus 1100 can have a modular construction. As shown, the printing apparatus 1100 can include at least one media feeder module 1102, a printer module 1106 adjacent the media feeder module 1102, an inverter module 1114 adjacent the printer module 1106, and at least one stacker module 1116 adjacent the inverter module 1114.

In the printing apparatus 1100, the media feeder module 1102 can be adapted to feed media 1104 having various sizes, widths, lengths, and weights to the printer module 1106. In the printer module 1106, toner is transferred from an arrangement of developer stations 1110 to a charged photoreceptor belt 1107 to form toner images on the photoreceptor belt 1107. The toner images are transferred to the media 1104 fed through a paper path. The media 1104 are advanced through a fuser 1112 adapted to fuse the toner images on the media 1104. The inverter module 1114 manipulates the media 1104 exiting the printer module 1106 by either passing the media 1104 through to the stacker module 1116, or by inverting and returning the media 1104 to the printer module 1106. In the stacker module 1116, printed media are loaded onto stacker carts 1117 to form stacks 1120. The stacker module 1116 can include the apparatus 100 to switch between compiling and stacking printed media.

Figure 12:
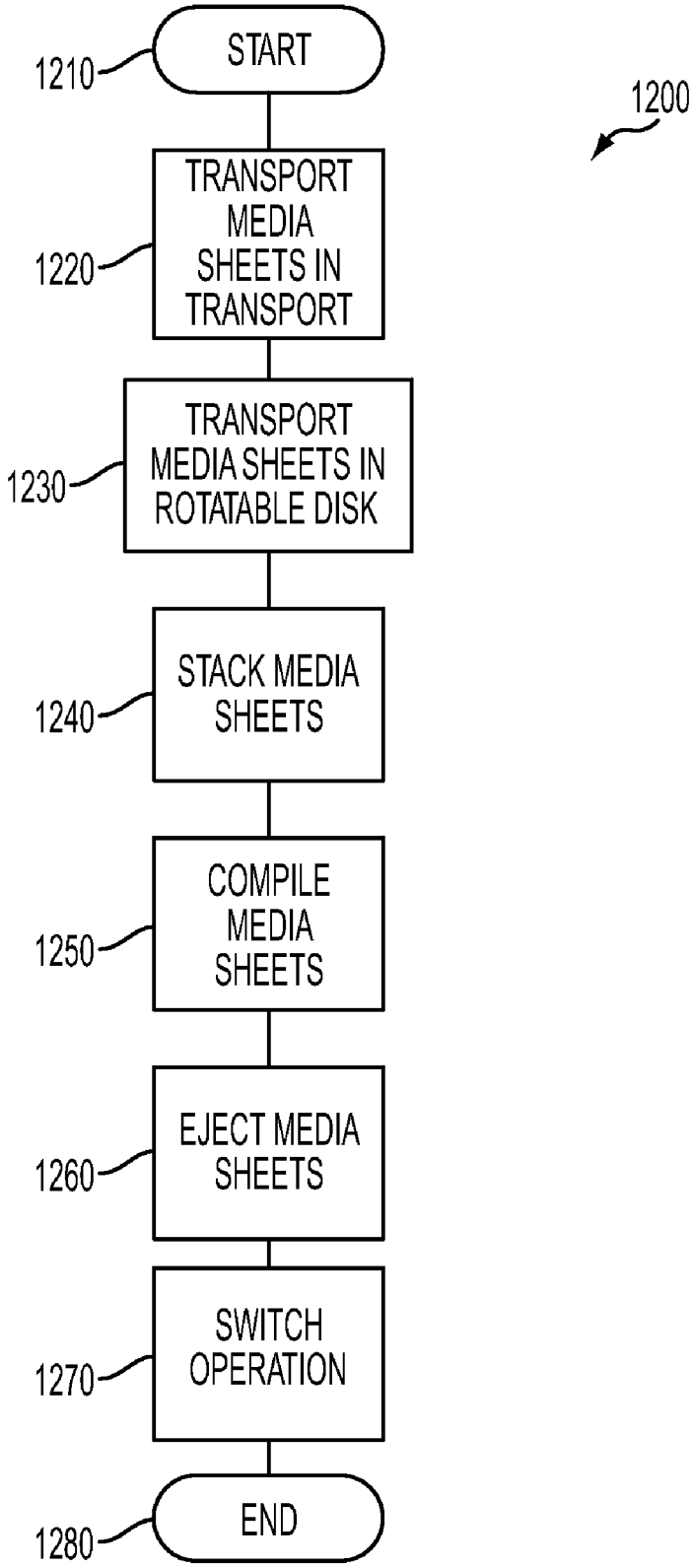
FIG. 12 illustrates an exemplary flowchart of a method according to a possible embodiment.

FIG. 12 illustrates an exemplary flowchart 1200 of a method of detecting a position of media in an apparatus having a media sheet transport, a stacker, a rotatable disk coupled to the media sheet transport, a compiler, and an ejector coupled to the compiler. The method starts at 1210. At 1220, media sheets are transported the media sheet transport. At 1230, the media sheets are transported in the rotatable disk using a leading edge of media sheets. At 1240, media sheets are stacked on the stacker. At 1250, the compiler compiles a set of a plurality of the media sheets. The compiler can also finish the set of a plurality of media sheets by fastening together the set of a plurality of the media sheets. At 1260, the ejector ejects the set of a plurality of the media sheets from the compiler onto the stacker. At 1270, operation is switched between the rotatable disk providing media sheets to the compiler and the rotatable disk providing media sheets to the stacker by moving the rotatable disk or the compiler relative to each other. At 1280, the method ends.

Embodiments can provide for a disk compiler that is capable of operating as a pure stacker by directly stacking sheets onto a stack and is also capable of operating as a set compiler capable of compiling, stapling, stitching, and/or otherwise finishing sets of media sheets by creating sets and depositing the sets onto the same stack as other sheets. Embodiments can be capable of switching between stacking and set compiling modes on the fly within a job if so required. Switching can be achieved by a movable compiler tray assembly that can be retracted out of a compiling zone when not needed. When set compiling is needed, the compiler can move so that the disk deposits sheets onto a compiler tray rather than onto the stack. The compiled set can then be moved a short distance off the stack to complete set finishing and the set can then be ejected back onto the stack. Short travel distances can be used to reduce the need to skip printing pitch cycles. Embodiments can provide for both high quality stacking and set compiling capability in the same tray.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. An apparatus comprising:

a media sheet transport configured to transport media sheets;

a stacker configured to stack the media sheets;

a rotatable disk coupled to the media transport, the rotatable disk configured to receive a leading edge of a media sheet and configured to transport the media sheet to the stacker; and a compiler configured to compile a set of a plurality of the media sheets; and an ejector configured to eject the set of a plurality of the media sheets from the compiler onto the stacker, wherein one of the rotatable disk and at least a portion of the compiler are movable relative to each other to switch between the rotatable disk providing media sheets to the stacker and the rotatable disk providing media sheets to the compiler, and wherein the compiler comprises a compiler tray configured to receive the set of a plurality of the media sheets, the compiler tray including a compiler tray register configured to register an edge of media sheets.

2. The apparatus according to claim 1, wherein the compiler is configured to finish the set of a plurality of the media sheets by fastening together the set of a plurality of the media sheets.

3. The apparatus according to claim 1, wherein one of the rotatable disk and at least a portion of the compiler are movable relative to each other and in a substantially planar direction relative to a planar surface of stacked sheets to switch between the rotatable disk providing media sheets to the stacker and the rotatable disk providing media sheets to the compiler.

4. The apparatus according to claim 1, wherein the compiler tray is configured to move in a direction parallel to a planar surface of stacked media sheets into an intercept position to intercept media sheets between the rotatable disk and the stacker.

5. The apparatus according to claim 4, wherein the compiler includes a finisher module configured to finish the set of a plurality of the media sheets, wherein the compiler tray is configured to move in a direction away from the intercept position to provide the set of a plurality of the media sheets to the finisher module to finish the set of a plurality of the media sheets.

6. The apparatus according to claim 1, wherein the rotatable disk is configured to move in a direction parallel to a planar surface of stacked media sheets between a position to transport the media sheets to the stacker and a position to transport media sheets to the compiler.

7. The apparatus according to claim 1, wherein the compiler is configured to move in a direction parallel to a planar surface of stacked media sheets into an intercept position to intercept the set of a plurality of the media sheets, compile the set of a plurality of the media sheets, and finish the set of a plurality of the media sheets.

8. The apparatus according to claim 7, further comprising a media sheet trail edge support configured to support a trail edge of media sheets when the compiler is in the intercept position.

9. The apparatus according to claim 7, wherein the compiler is configured to move in a direction parallel to a planar surface of stacked media sheets out of the intercept position to provide a finished set of a plurality of the media sheets to the stacker.

10. The apparatus according to claim 7, wherein the compiler is configured to move in a direction parallel to a planar surface of stacked media sheets out of the intercept position to allow the rotatable disk to transport media sheets to the stacker.

11. The apparatus according to claim 7, wherein the ejector is configured to eject the set of a plurality of the media sheets from the compiler onto the stacker while the compiler is in the intercept position.

12. The apparatus according to claim 1, further comprising a retractable stacker register, the retractable stacker register configured to register an edge of media sheets.

13. The apparatus according to claim 1, wherein the stacker is configured to stack single media sheets and finished sets of a plurality of media sheets.

14. An apparatus comprising:

a media sheet transport configured to transport media sheets;

a stacker configured to stack the media sheets;

a rotatable disk coupled to the media transport, the rotatable disk configured to receive a leading edge of a media sheet and configured to transport the media sheet to the stacker;

a retractable stacker register, the retractable stacker register configured to register an edge of media sheets;

a compiler configured to compile a set of a plurality of the media sheets, the compiler including a compiler tray configured to receive the set of a plurality of the media sheets, and the compiler tray including a compiler tray register configured to register an edge of media sheets; and an ejector operable at least parallel to a planar surface of stacked media sheets to eject the set of a plurality of the media sheets from the compiler onto the stacker, wherein one of the rotatable disk and the compiler are movable relative to each other to switch between the rotatable disk providing media sheets to the stacker and the rotatable disk providing media sheets to the compiler.

15. The apparatus according to claim 14, wherein the compiler includes a finisher configured to finish the set of a plurality of the media sheets by fastening together the set of a plurality of the media sheets.

16. The apparatus according to claim 14, wherein the compiler tray is configured to move parallel to a planar surface of stacked media sheets into an intercept position to intercept media sheets between the rotatable disk and the stacker and configured to compile the set of a plurality of the media sheets.

17. The apparatus according to claim 16, wherein the compiler tray is configured to move in a direction away from the intercept position to provide the set of a plurality of the media sheets to the compiler.

18. A method in an apparatus including a media sheet transport, a stacker, a rotatable disk coupled to the media sheet transport, a compiler tray, and an ejector coupled to the compiler tray, the method comprising:

transporting media sheets in the media sheet transport;

transporting the media sheets in the rotatable disk using a leading edge of media sheets;

stacking the media sheets on the stacker;

compiling, with the compiler tray, a set of a plurality of the media sheets;

ejecting, with the ejector, the set of a plurality of the media sheets from the compiler tray onto the stacker; and switching between the rotatable disk providing media sheets to the compiler tray and the rotatable disk providing media sheets to the stacker by moving one of the rotatable disk and the compiler tray relative to each other in a linear direction.

19. The method according to claim 18, further comprising finishing the set of a plurality of the media sheets in the compiler tray by fastening together the set of a plurality of the media sheets.

* * * * *